United States Patent [19]

Ciuba et al.

[11] Patent Number: 4,915,872

[45] Date of Patent: Apr. 10, 1990

[54] CAST SOLID BLOCK CORROSION INHIBITOR COMPOSITION

[75] Inventors: Stanlay J. Ciuba, Burnsville; Guillermo C. Etienne, St. Louis Park, both of Minn.

[73] Assignee: Drew Chemical Corporation, Boonton, N.J.

[21] Appl. No.: 333,872

[22] Filed: Apr. 3, 1989

Related U.S. Application Data

[63] Continuation of Ser. No. 89,192, Oct. 1, 1987, abandoned.

[51] Int. Cl.[4] ..... C23F 11/08

[52] U.S. Cl. ..... 252/389.3; 252/389.4; 252/387

[58] Field of Search ..... 252/389.3, 389.4, 387, 252/8.552, 8.555; 422/18

[56] References Cited

U.S. PATENT DOCUMENTS

| | | | |
|---|---|---|---|
| 2,815,328 | 12/1957 | Green et al. | 252/75 |
| 2,961,291 | 11/1960 | Pickett et al. | 21/2.7 |
| 2,972,581 | 2/1961 | Johnson et al. | 252/75 |
| 3,240,707 | 3/1966 | Dulat | 252/75 |
| 3,282,846 | 11/1966 | Scott | 252/75 |
| 3,812,021 | 5/1974 | Craig et al. | 204/58 |
| 3,873,349 | 3/1975 | Kimura et al. | 117/93.31 |
| 3,886,076 | 5/1975 | Venable | 252/62 |
| 3,936,583 | 2/1976 | Lloyd et al. | 428/450 |
| 3,948,792 | 4/1976 | Watsen et al. | 252/181 |
| 3,962,109 | 6/1976 | Oberhofer et al. | 252/146 |
| 4,040,842 | 8/1977 | Mekishima et al. | 106/1 |
| 4,063,663 | 12/1977 | Copeland et al. | 222/52 |
| 4,083,795 | 4/1978 | Joubert | 252/99 |
| 4,086,096 | 4/1978 | McLeod | 106/1.17 |
| 4,110,117 | 8/1978 | McLeod | 106/1.17 |
| 4,149,985 | 4/1979 | Wilson | 252/74 |
| 4,237,090 | 12/1980 | DeMonbrun et al. | 422/13 |
| 4,239,648 | 12/1980 | Marshall et al. | 252/389 |
| 4,242,214 | 12/1980 | Lambert, Jr. | 252/75 |
| 4,382,008 | 5/1983 | Boreland et al. | 252/75 |
| 4,382,870 | 5/1983 | Abel et al. | 252/75 |
| 4,426,309 | 1/1984 | Abel et al. | 252/75 |
| 4,426,362 | 1/1984 | Copeland et al. | 422/263 |
| 4,427,499 | 1/1984 | Hitomi et al. | 204/27 |
| 4,440,721 | 4/1984 | Wilson et al. | 422/16 |
| 4,455,248 | 6/1984 | Wood | 252/75 |
| 4,569,781 | 2/1986 | Fernholz et al. | 252/92 |
| 4,584,104 | 4/1986 | Dubin | 422/18 |
| 4,659,481 | 4/1987 | Chen | 422/18 X |
| 4,717,495 | 1/1988 | Hercamp | 252/389.4 X |

*Primary Examiner*—John F. Terapane
*Assistant Examiner*—Gary L. Geist
*Attorney, Agent, or Firm*—Merchant, Gould, Smith, Edell, Welter & Schmidt

[57] ABSTRACT

A solid cast block of corrosion inhibitor composition, comprising: (i) about 5 to 20 wt-% silicate, calculated as sodium metasilicate pentahydrate; (ii) about 5 to 90 wt-% borate, calculated as sodium tetraborate pentahydrate; (iii) about 0.5 to 5 wt-% polymeric dispersant such as polyacrylamide; and (iv) a sufficient solidifying amount of water.

4 Claims, 1 Drawing Sheet

FIG. 1
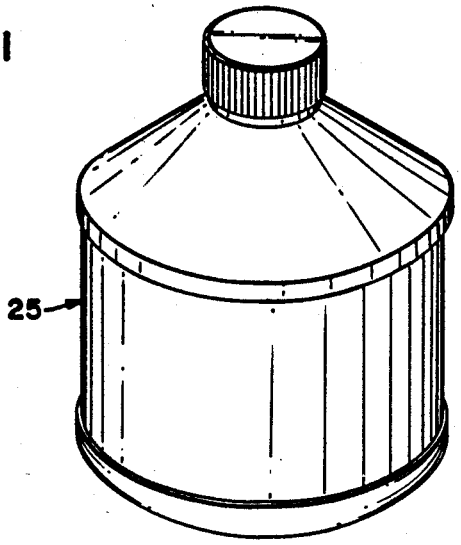
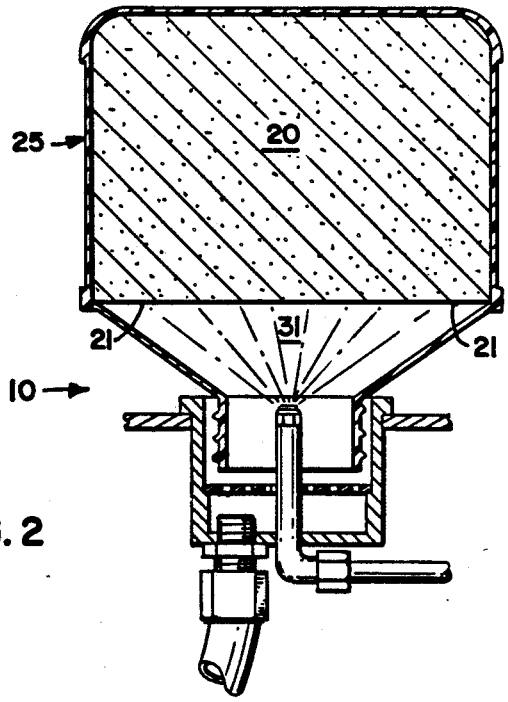
FIG. 2

CAST SOLID BLOCK CORROSION INHIBITOR COMPOSITION

This is a continuation of application Ser. No. 089,192, filed Oct. 1, 1987, now abandoned.

FIELD OF THE INVENTION

Broadly, our invention relates to corrosion inhibitor compositions and methods for dispensing such compositions. More specifically, our invention relates to nitrite and nitrate free, solid cast corrosion inhibitor compositions and methods for dispensing such compositions as an aqueous solution.

BACKGROUND

Corrosion inhibitor compositions containing nitrite and/or nitrate salts are well known. While effective at reducing corrosion, the use of such compositions must be carefully monitored as nitrite and nitrate salts are toxic. To reduce the hazard created by the presence of nitrite and/or nitrate salts, corrosion inhibitor compositions free of nitrite and nitrate salts have been created. One such nitrite and nitrate salt free corrosion inhibitor composition disclosed in U.S. Pat. No. 3,948,792 discloses an aqueous solution of an alkali metal silicate, an alkali metal borate and a polymeric dispersant. One drawback associated with this composition is the inability to form a highly concentrated corrosion inhibitor composition because of the low water solubility of silicates and borates. A concentrated form could reduce shipping and handling costs and reduce the storage area required.

Accordingly, a substantial need exists for a concentrated, nitrite and nitrate free, corrosion inhibitor composition which may be conveniently dispensed into an aqueous system.

SUMMARY OF THE INVENTION

In a first aspect, our invention is a solid cast block of corrosion inhibitor composition, comprising: (a) about 5 to 20 wt-% silicate, calculated as sodium metasilicate pentahydrate; (b) about 50 to 90 wt-% borate, calculated as sodium tetraborate pentahydrate; (c) about 0.5 to 5 wt-% polymeric dispersant; and (d) a sufficient solidifying amount of water.

In a second aspect, our invention is an article of commerce comprising the solid cast block of corrosion inhibitor composition described above intimately retained within a container such that only the top surface of the composition is exposed.

In a third aspect, our invention is a method for dispensing the solid cast block of corrosion inhibitor composition as a concentrated solution into an aqueous system; the method comprising the steps of: (a) obtaining a solid block of the corrosion inhibitor composition; (b) placing the composition into a dispenser having a means for retaining the composition and a means for spraying the composition with a solvent; (c) spraying a solvent onto the composition to dissolve a portion of the composition and form a concentrated solution; and (d) directing the concentrated solution from the dispenser into the aqueous system.

Unless otherwise indicated, "weight percent", as employed in the specification and claims, is based upon the total corrosion inhibitor composition.

As utilized herein, "wt-% water" refers to both free and hydrated forms of water regardless of how it is introduced into the composition.

BRIEF DESCRIPTION OF THE DRAWINGS

FIG. 1 is a perspective view of one embodiment of the article of commerce of this invention.

FIG. 2 is a cross-sectional view of one embodiment of a dispenser for dispensing the corrosion inhibitor composition retained within the article of commerce shown in FIG. 1.

DETAILED DESCRIPTION OF THE INVENTION INCLUDING A BEST MODE

An effective nitrite and nitrate salt free corrosion inhibiting composition can be formed by combining about 5 to 20 wt-%, preferably 10–15 wt-%, silicate, calculated as sodium metasilicate pentahydrate; about 50 to 90 wt-%, preferably 70–90 wt-%, borate, calculated as sodium tetraborate pentahydrate; about 0.5 to 5 wt-%, preferably 1–5 wt-%, polymeric dispersant; and about 10 to 30 wt-%, preferably 15–20 wt-%, water. This combination results in a castable, substantially homogeneous composition capable of conveniently being dispensed as an aqueous solution at a rate of about 0.5 to 10 grams of composition per minute employing the preferred dispenser.

Silicates which may be usefully employed in our corrosion inhibitor composition include the "soluble silicates" (i.e. silicates combined with an alkali metal). The soluble silicates are combinations of varying ratios of silicon dioxide and an alkali metal oxide, typically formed by melting sand with soda ash at about 1,450° C. The ratio of silicon dioxide to alkali metal oxide in the soluble silicate is determined by the proportions of sand and soda ash added to the furnace. The formation of soluble silicates follows the simple equation:

$$Na_2CO_3 + nSiO_2 \xrightarrow{\Delta} Na_2O.SiO_2 + CO_2$$

A list of silicates which may be employed in our composition include specifically but not exclusively sodium orthosilicate, sodium sequisilicate, sodium sequisilicate pentahydrate, sodium metasilicate, sodium metasilicate pentahydrate, sodium metasilicate hexahydrate, sodium metasilicate octahydrate, sodium metasilicate anhydrate, sodium disilicate, sodium trisilicate, sodium tetrasilicate, potassium metasilicate, potassium metasilicate hemihydrate, potassium metasilicate monohydrate, potassium disilicate, potassium disilicate monohydrate, potassium tetrasilicate, and potassium tetrasilicate monohydrate. Because of its excellent solubility in cold water, ease of availability and low cost the preferred soluble silicate is sodium metasilicate pentahydrate.

Borates which may be usefully employed in our corrosion inhibitor composition include the hydrated and anhydrous forms of alkali metal borates. Many types of borates are available as a natural mineral, while others are derived from the natural borates in a number of well known methods. For a detailed discussion of borates, see Kirk-Othmer, *Encyclopedia of Chemical Technology*, 2d Ed., Vol. 3, pp. 608–651.

A list of borates which may be employed in our composition include specifically but not exclusively the anhydrous and hydrated forms of sodium tetraborate, sodium metaborate and sodium pentaborate.

Water is employed to assist in blending and create a castable composition. Insufficient water results in a brittle composition. Excessive water results in a flowable composition. Typically a water content, including water of hydration, of about 10–30 wt-% will achieve the desired results.

The use of silicates in an aqueous environment is not completely free of drawbacks. Silicates can precipitate from solution and form a silicate scale on that equipment in contact with the solution. Incorporation of a polymeric dispersant into the solution can significantly reduce this problem. The polymeric dispersant aids in maintaining the silicate in solution and tends to modify the crystalline structure of that silicate which does precipitate such that the precipitate does not tenaciously adhere to the equipment and may be carried away by the flow of solution. Suitable dispersants include water soluble carboxylic acid containing polymers, polyacrylonitrile, polyacrylamide, etc.

PREPARATION

Our corrosion inhibitor composition may be prepared by any convenient method so long as the composition is well mixed and castable. Due to the high melting point of the borate and silicate components which can exceed 1000° F., a preferred method of making the composition comprises the steps of: (a) heating the water to a temperature sufficient to dissolve the borate and silicate components and prevent the borate and silicate from immediately hydrating the water so as to form a solid; (b) adding the borate and silicate to the water under constant agitation; (c) adding the polymeric dispersant to the borate and silicate containing water under constant agitation; (d) blending the resultant solution until homogeneous; and (e) allowing the solution to cool and solidify.

The corrosion inhibitor composition may be cast into a mold from which it is removed when solidified or may be cast directly into a container in which it is sold. Referring to FIG. 1, the corrosion inhibitor composition is preferably cast directly into a container 25 in which it can be sold and used, thereby eliminating the removal and transfer step.

The container may be made of any material capable of retaining the liquid and solid corrosion inhibitor composition. A list of usable materials includes specifically but not exclusively metals such as aluminum and steel; glass; structural resins such as polyolefins (i.e. polyethylene), polyesters (i.e. dacron), polyamides (i.e. nylon), etc. Because it can effectively retain the composition at a low cost, the preferred material is either polyethylene or polypropylene; polypropylene being the most preferred.

For dispensing from the preferred type of dispenser the container must leave at least one of the surfaces of the corrosion inhibiting composition exposed so that the dissolving solvent may be sprayed upon, contact and dissolve a portion of the corrosion inhibitor composition. As an aid to maintaining a constant dissolving surface area, which in turn assists in maintaining a constant concentration of corrosion inhibitor in the concentrated solution, the container leaves only one exposed surface and provides a uniform lateral cross-sectional area.

The corrosion inhibitor composition may be cast into any desired size and shape. Preferably the composition is cast into about 3 to 10 liter capsules having an exposed surface area of about 50 to 500 square centimeters; most preferably about 3 to 4 liter capsules having an exposed surface area of about 150 to 200 square centimeters in order to achieve a short time period necessary to complete solidification providing a dissolvable surface area sufficient to ensure an effective dispensing rate, and providing an easily shipped and handled product.

DISPENSING

Our solid cast corrosion inhibiting composition is dispensed by dissolving the composition in water to form a solution which is then added to the aqueous system wherein the prevention of corrosion is desired. To ensure a ready supply of the corrosion inhibiting solution, the solid cast corrosion inhibitor composition may be dissolved prior to use and retained within a reservoir. However, such a system destroys many of the advantages of using a concentrated corrosion inhibiting cast composition as it increases the opportunities for spillage and increases the size of the dispensing equipment.

Referring to FIG. 2, a preferred means of dispensing our solid cast corrosion inhibitor composition comprises impinging a water spray 31 upon exposed surface 21 of the solid block of corrosion inhibitor composition 20, thereby dissolving a portion of the corrosion inhibitor composition 20 and forming a concentrated solution which, immediately upon being formed, passes out of the dispenser 10 and into the aqueous system. Such dispensers are disclosed in U.S. Pat. Nos. 4,426,362; 4,569,780; and 4,569,781.

The most effective corrosion inhibiting concentration of corrosion inhibitor depends upon many variables such as the type of system being treated, the amount of recirculation, the hardness of the water, the composition of the corrosion inhibitor, etc. While the factors listed above can significantly affect the most effective concentration, we have found that a concentration of about 3,000 to 10,000 ppm corrosion inhibitor composition is generally effective in controlling corrosion.

The foregoing discussion provides the detailed discussion of the preferred embodiments of the invention including a best mode. Since many embodiments of the invention can be made without departing from the spirit and scope of the invention, the invention resides in the claims hereinafter appended.

We claim:

1. A composition comprising:

(a) about 5 to 20 wt-% silicate, calculated as sodium metasilicate pentahydrate;

(b) about 70 to 90 wt-% borate, calculated as sodium tetraborate pentahydrate;

(c) about 0.5 to 5 wt-% polymeric dispersant; and (d) about 10 to 30 wt-% water; the composition being substantially free of any nitrite or nitrate salts, and cast into a solid block.

2. The composition of claim 1 wherein the composition comprises:

(a) about 10 to 15 wt-% alkali metal silicate, calculated as sodium metasilicate pentahydrate;

(b) about 70 to 90 wt-% alkali metal borate, calculated as sodium tetraborate pentahydrate;

(c) about 1 to 5 wt-% polymeric dispersant, and (d) about 15 to 20 wt-% water.

3. The composition of claim 1 wherein the polymeric dispersant is polyacrylamide.

4. The composition of claim 1 wherein the solid block is about 200 to 4,000 grams.

* * * * *